US007496181B2

(12) United States Patent
Mazin et al.

(10) Patent No.: US 7,496,181 B2
(45) Date of Patent: Feb. 24, 2009

(54) X-RAY COLLIMATOR FOR IMAGING WITH MULTIPLE SOURCES AND DETECTORS

(75) Inventors: Samuel R. Mazin, Stanford, CA (US); Norbert J. Pelc, Los Altos, CA (US)

(73) Assignee: The Board of Trustees of the Leland Stanford Junior University, Palo Alto, CA (US)

( * ) Notice: Subject to any disclaimer, the term of this patent is extended or adjusted under 35 U.S.C. 154(b) by 179 days.

(21) Appl. No.: 11/606,408

(22) Filed: Nov. 28, 2006

(65) Prior Publication Data

US 2007/0133749 A1 Jun. 14, 2007

Related U.S. Application Data

(60) Provisional application No. 60/740,024, filed on Nov. 28, 2005.

(51) Int. Cl.
*G21K 1/02* (2006.01)

(52) U.S. Cl. ..... 378/149; 378/147

(58) Field of Classification Search ..... 378/42, 378/147, 149, 154

See application file for complete search history.

(56) References Cited

U.S. PATENT DOCUMENTS 4,315,157 A 2/1982 Barnes
4,465,540 A * 8/1984 Albert ..... 156/252
5,859,893 A 1/1999 Moorman et al.
6,229,870 B1 5/2001 Morgan
6,389,108 B1 * 5/2002 Ein-Gal ..... 378/147
6,792,077 B2 * 9/2004 Rand ..... 378/149
2004/0028181 A1 2/2004 Charles, Jr. et al.
2004/0120464 A1 6/2004 Hoffman

* cited by examiner

*Primary Examiner*—Edward J. Glick
*Assistant Examiner*—Mona M. Sanei
(74) *Attorney, Agent, or Firm*—Lumen Patent Firm, Inc.

(57) ABSTRACT

Reduced source spacing for multi-source, multi-detector X-ray imaging systems is provided by allowing channels within an X-ray collimator to intersect within the body of the collimator. As a result, the channels are not independent, and the source spacing can be significantly reduced. Although such collimators have a much more "open" structure than conventional collimators having independent channels, they can still provide efficient collimation performance (e.g., predicted leakage <5%). Several high attenuation layers having through holes and stacked together can provide collimators according to the invention, where the through holes combine to form the intersecting channels.

16 Claims, 6 Drawing Sheets

X-RAY COLLIMATOR FOR IMAGING WITH MULTIPLE SOURCES AND DETECTORS

CROSS REFERENCE TO RELATED APPLICATIONS

This application claims the benefit of U.S. provisional application 60/740,024, filed on Nov. 28, 2005, entitled "X-ray Collimator for Imaging with Multiple Sources and Detectors", and hereby incorporated by reference in its entirety.

FIELD OF THE INVENTION

This invention relates to X-ray imaging.

BACKGROUND

In many applications of X-ray imaging, and especially in medical imaging applications, it is highly desirable to minimize the total X-ray dose delivered during imaging to the subject or object being imaged. Since X-rays travel substantially in straight lines, X-rays emitted from the X-ray source (or sources) directed away from any X-ray detector in the system are useless for imaging. Such useless radiation is typically blocked by providing an X-ray collimator near the X-ray source that passes radiation directed toward the detector(s) and blocks other radiation.

Various X-ray imaging systems have been considered in the art, and a corresponding variety of X-ray collimation approaches for imaging have also been considered. For example, in U.S. Pat. No. 4,315,157, an imaging approach having a single X-ray source and multiple well-separated detectors is considered. A collimator is employed to block radiation that otherwise would pass through the patient and strike the dead spaces between the detectors. Fan beam systems (e.g., as in U.S. Pat. No. 6,229,870) are commonly employed, where a collimator having vanes defines several parallel thin fan-shaped beams.

Conventional X-ray collimators typically provide vanes to define fan beams and/or high aspect ratio channels to define narrow beams, e.g., as considered in US 2004/0120464. Collimators having a large rectangular aperture matched in shape to a rectangular detector array are considered in US 2004/0028181. In U.S. Pat. No. 5,859,893, a system having multiple source locations and multiple detectors is considered. The corresponding collimator has independent high aspect ratio channels defining beam paths from each source to each detector.

However, when an X-ray imaging system has multiple sources and multiple detectors, conventional X-ray collimation approaches (e.g., providing independent channels for each source to detector path) can encounter a hitherto unappreciated difficulty. More specifically, providing such independent channels in the collimator can lead to a situation where the X-ray source spacing is forced to be undesirably large.

Accordingly, it would be an advance in the art to provide an X-ray collimator for multi-source, multi-detector imaging systems that can provide reduced source spacing.

SUMMARY

Reduced source spacing for multi-source, multi-detector X-ray imaging systems is provided by allowing channels within an X-ray collimator to intersect within the body of the collimator. As a result, the channels are not independent, and the source spacing can be significantly reduced. Although such collimators have a much more "open" structure than conventional collimators having independent channels, they can still provide efficient collimation performance (e.g., predicted leakage <5%). Several high attenuation layers having through holes and stacked together can provide collimators according to the invention, where the through holes combine to form the intersecting channels.

DETAILED DESCRIPTION

Figure 1:
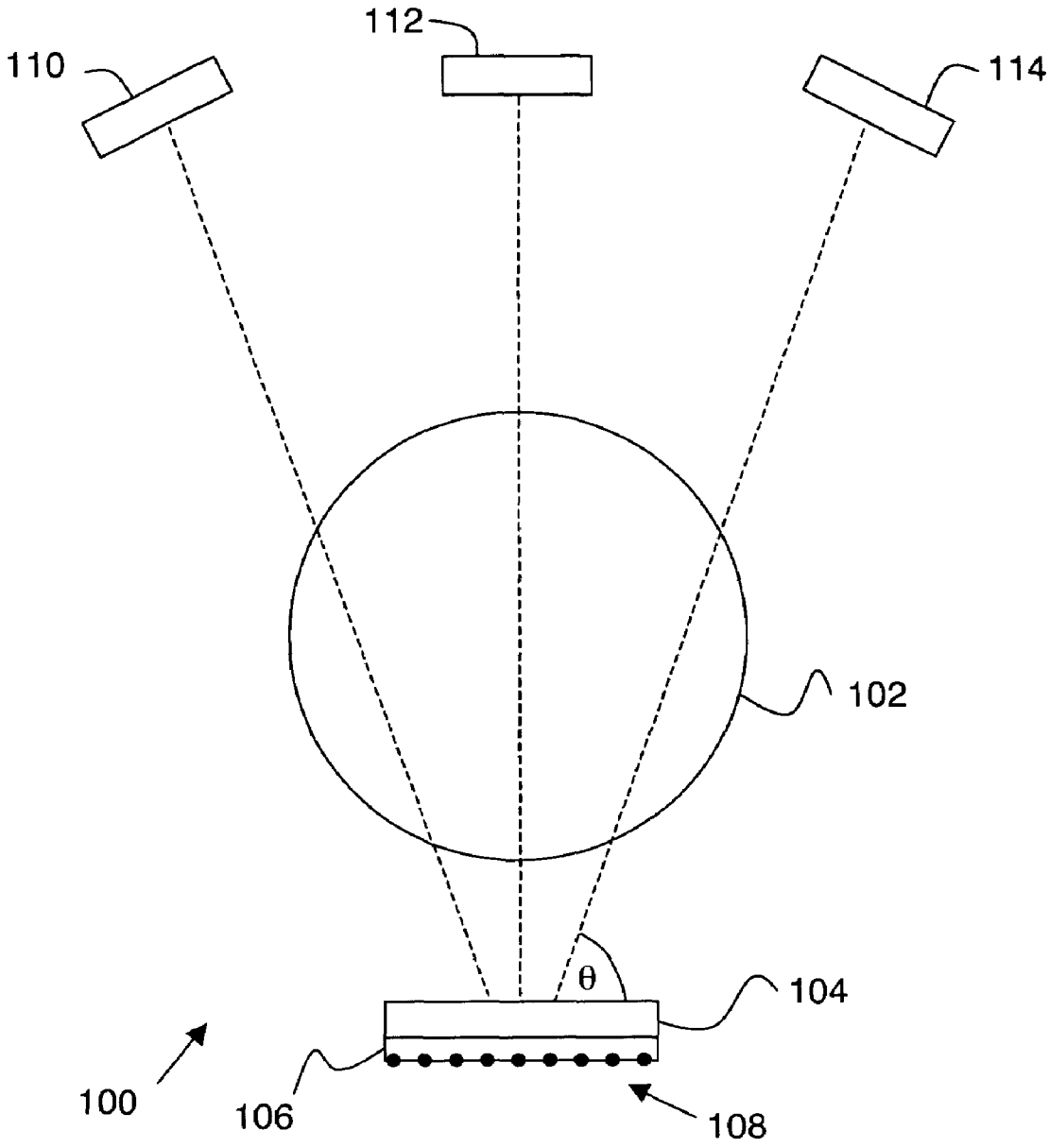
FIG. 1 shows an X-ray imaging system according to an embodiment of the invention.

FIG. 1 shows a transverse view of an X-ray imaging system 100 according to an embodiment of the invention. In this example, an X-ray source (or source array) emits X-rays from multiple source locations 108. Typically the source locations are disposed on a substrate and cooling layer 106 (e.g., when a transmission target is employed). X-rays emitted from source locations 108 pass through substrate 106 and through a field of view 102 (which may include, e.g., a patient) and are received by well-separated detectors (typically detector arrays) 110, 112, and 114.

Imaging system 100 includes a collimator 104, which substantially absorbs X-rays emitted from any of source locations 108 that are directed away from any of the detectors (i.e., detectors 110, 112, and 114). As indicated above, such absorption of undetectable X-rays that are useless for imaging is highly desirable. Collimator 104 can be designed to pass X-rays passing through the collimator from each source location at a set of predetermined angles θ corresponding to the detectors. These predetermined angles are unique for each source location and vary gradually from one source location to the next.

Figure 2:
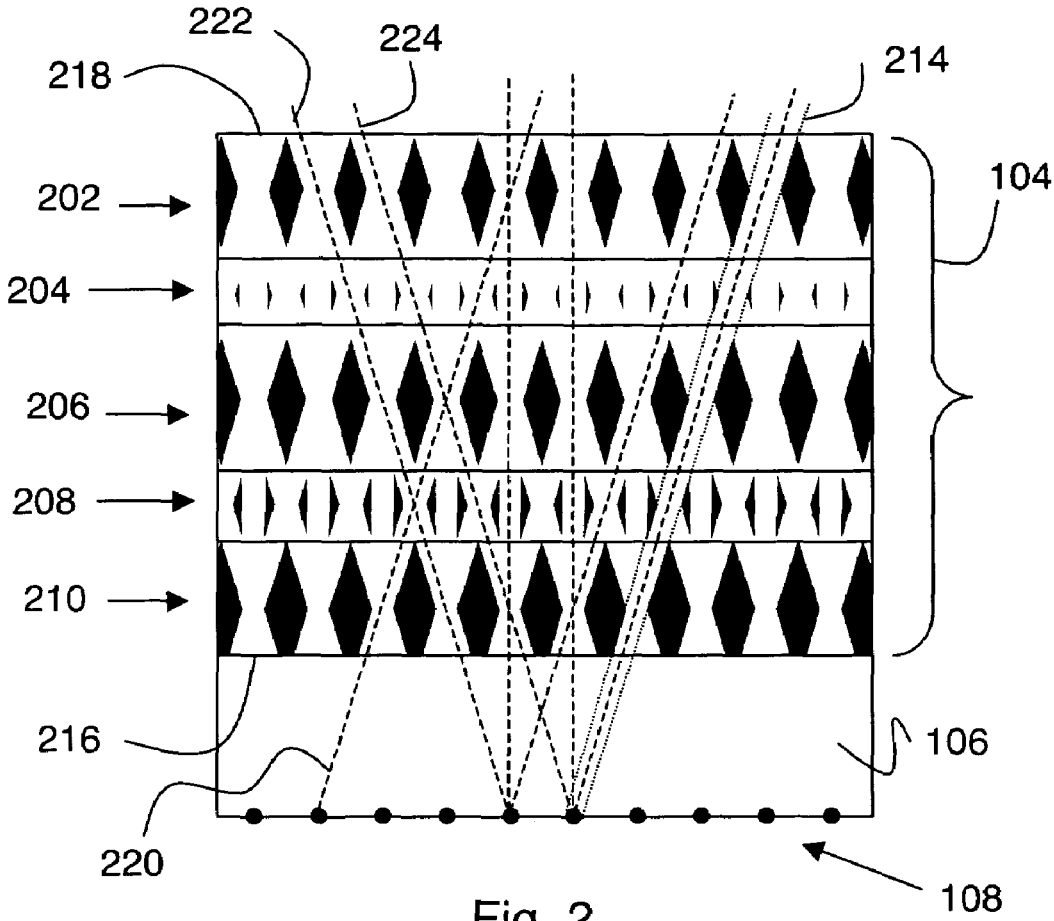
FIG. 2 shows an X-ray collimator according to an embodiment of the invention.

FIG. 2 shows an X-ray collimator according to an embodiment of the invention. In the example of FIG. 2, collimator 104 includes high attenuation layers 202, 204, 206, 208 and 210 arranged in a layer by layer stack to provide collimator 104 having an input face 216 and an output face 218. Each high attenuation layer includes two or more through holes, and the through holes in the high attenuation layers combine to form four or more channels extending through collimator 104 from input face 216 to output face 218. Some of these channels are identified with dashed lines on FIG. 2, such as channels 222, 224, and 220. In preferred embodiments of the invention, the channels taper such that they are larger at the output face than at the input face, e.g., as shown by dotted lines 214. In this manner, the channel shapes can follow the natural divergence of the X-rays as they propagate away from source locations 108.

High attenuation layers 202, 204, 206, 208, and 210 are preferably made of X-ray absorbing material (e.g., including high-Z elements). Suitable materials for the high attenuation layers include but are not limited to brass, tungsten, lead, molybdenum, and mixtures or alloys thereof. Although the example of FIG. 2 shows five high attenuation layers, the invention can be practiced with any number of high attenuation layers greater than two.

A key aspect of the invention is that these channels are not independent. More specifically, at least two channels intersect within the collimator at a location other than at the input face or output face (e.g., the intersection of channels 220 and 222). Typically, as shown in the example of FIG. 2, there will be numerous such internal intersections of channels. In many cases, a channel will also have multiple internal intersections with other channels (e.g., channel 220 has internal intersections with channel 222 and with channel 224). Such intersecting, non-independent collimator channels allow for a much closer source location spacing than the conventional approach of independent channels that have no intersections within the body of a thick collimator.

Figure 7:
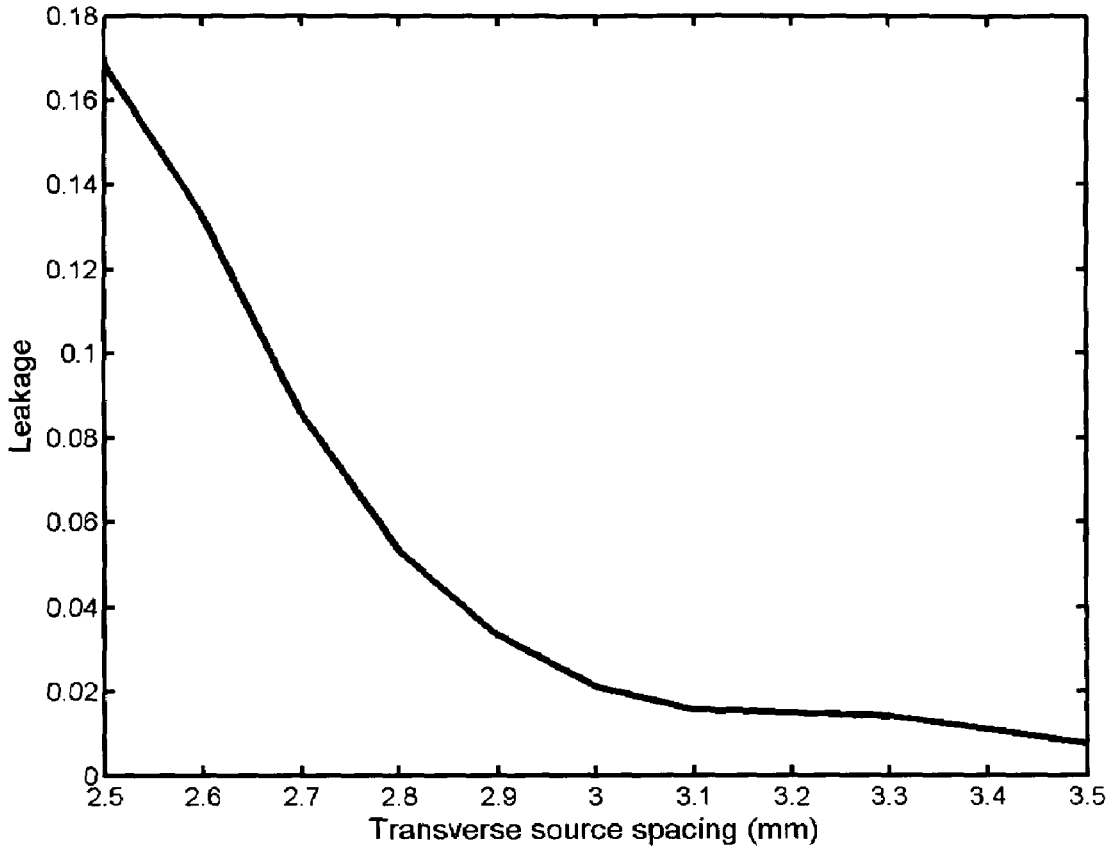
FIG. 7 shows a plot of calculated collimator leakage vs. source spot spacing for an embodiment of the invention.

Good collimation performance can be obtained with this approach. Such good performance is surprising, since the collimator of FIG. 2 is much more "open" in structure than conventional collimators having independent channels. Collimator performance calculations have been performed. In these calculations, the following parameters were assumed. A brass ($\mu$=6.735 $cm^{-1}$ at 80 keV) collimator having a thickness of 4 cm was employed. A configuration having three detectors was assumed, the detector angles $\theta$ being 0°, 17° and −17° at the central source location of the source array. Each source location was assumed to emit 80 keV X-rays in a +/−60° arc. A leakage factor $L=N_U/N_D$ was defined, where $N_U$ is the number of undetectable primary photons passing through the imaging filed of view, and $N_D$ is the number of detectable primary photons passing through the imaging field of view. For a 2.5 mm source location spacing, L=0.1685. For a 3 mm source location spacing, L=0.021. In practice, it is desirable for L to be less than 0.05, so this goal is easily reached with the 3.0 mm source location spacing. Leakage decreases as source separation increases, as shown on FIG. 7, which is a plot of L as a function of source location spacing for this numerical example.

Figure 3:
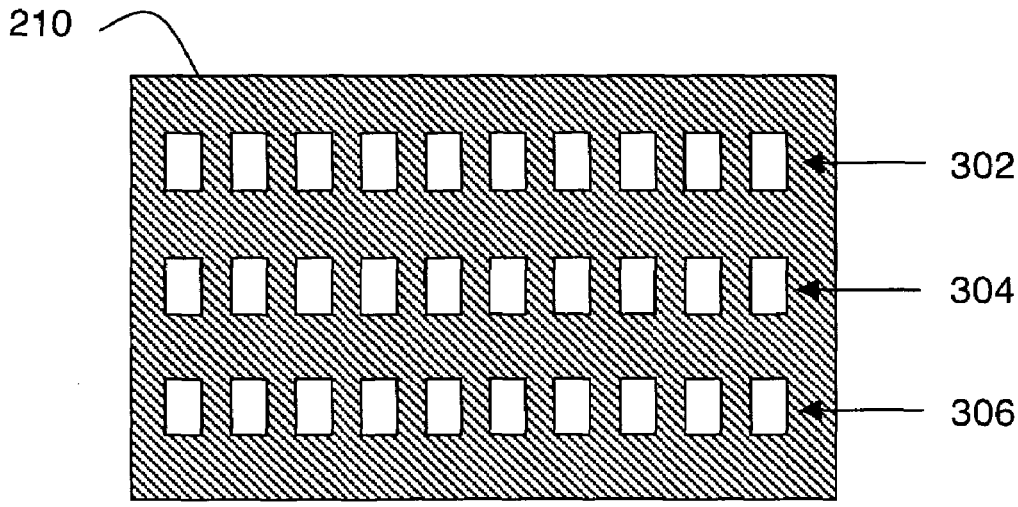
FIG. 3 shows a top view of a layer of the collimator of FIG. 2.

FIG. 3 shows a top view of layer 210 of collimator 104, which is shown in a side view on FIG. 2. Several sets of through holes are present in layer 210, and are indicated as sets 302, 304, and 306. Each such set corresponds to a different axial location in imaging system 100. In this example, the collimator channels only intersect in transverse planes (e.g., as shown on FIG. 2). Axial collimation is provided by the height of the holes in sets 302, 304, and 306, and may restrict the X-rays to all or only part of the axial extent of the detectors, depending on the imaging application.

Conventional layer fabrication and assembly methods are suitable for fabricating and assembling the high attenuation layers of collimators according to the invention. For example, these layers can be made by precision drilling methods, such as laser drilling, mechanical drilling or chemical etching. Each layer would have its own pattern, and could further include features for facilitating precision alignment, such as alignment holes in each layer. Pins can be inserted through such alignment holes during assembly to keep the layers aligned. A high attenuation layer having through holes with sloped edges (e.g., high attenuation layer 210 on FIG. 2) can be provided by fabricating the high attenuation layer as a laminate, each layer of the laminate having through holes which gradually change size and/or shape from one layer to the next to provide a stepwise approximation to the sloped hole edge.

Figure 4A:
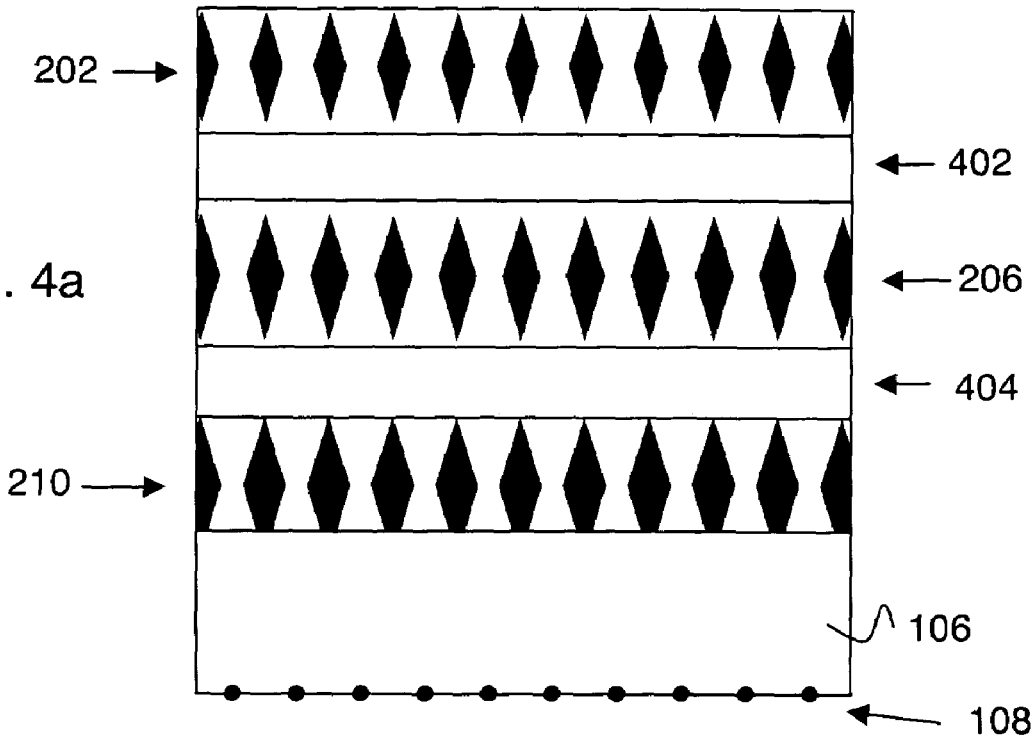
FIGS. 4*a-b* show X-ray collimators according to alternate embodiments of the invention.
Figure 4B:
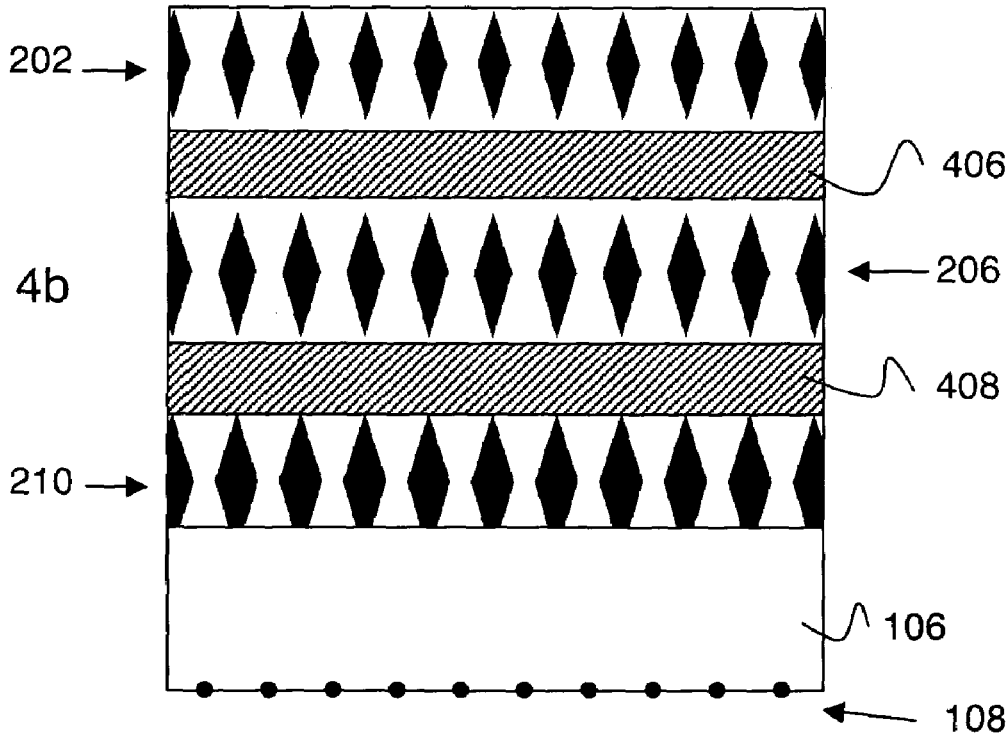

FIGS. 4*a-b* show X-ray collimators according to alternate embodiments of the invention. In these embodiments, high attenuation layers providing relatively small levels of X-ray attenuation (e.g., 204 and 208 on FIG. 2) are removed from the collimator, thereby simplifying collimator design and fabrication without appreciably altering performance. FIG. 4*a* shows a configuration where omitted high attenuation layers are replaced by air gaps 402 and 404. FIG. 4*b* shows a configuration where omitted high attenuation layers are replaced with transparent layers 406 and 408, which do not provide significant X-ray attenuation, relative to the high attenuation layers. Low Z materials are suitable for the transparent layers, although high-Z materials can also be employed if the combination of density and thickness of the high-Z material is such that X-ray absorption is relatively small in the transparent layer. Suitable materials for such transparent layers include, but are not limited to low density plastics, fiber material, carbon fiber, and microspheres in an epoxy matrix. Sufficiently thin layers of Al can also be employed as transparent layers, since Al is relatively X-ray transparent compared to most other common metals.

Figure 5:
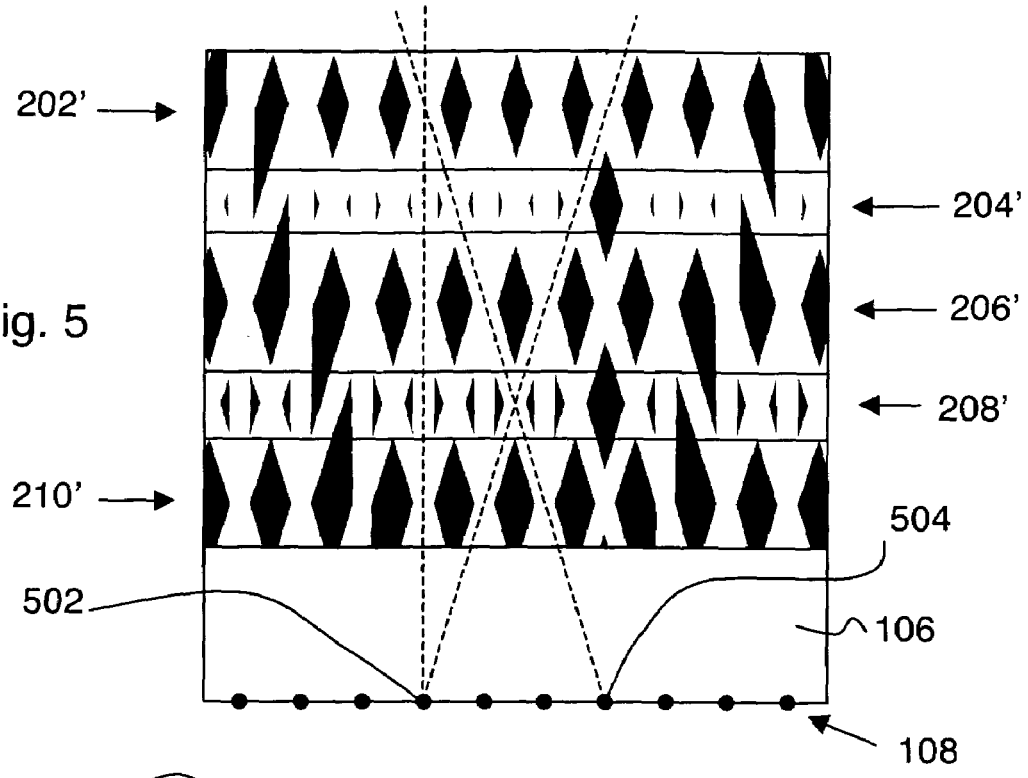
FIG. 5 shows an X-ray collimator according to an embodiment of the invention having a differing number of collimator channels per X-ray source location.

Embodiments of the invention can provide a great deal of flexibility in controlling the pattern of X-rays delivered to a field of view by an X-ray imaging system. In particular, any one source location can be collimated to deliver X-rays to one, some or all of the detectors. FIG. 5 shows an X-ray collimator according to an embodiment of the invention having a differing number of collimator channels per X-ray source location. In this example, most source locations provide X-rays to three detectors, as on FIG. 2. However, source location 502 provides X-rays to only two detectors, and source location 504 provides X-rays to only one detector. The hole patterns in layers 202', 204', 206', 208', and 210' can be changed as shown on FIG. 5 in order to accomplish this and similar modifications.

Figure 6A:
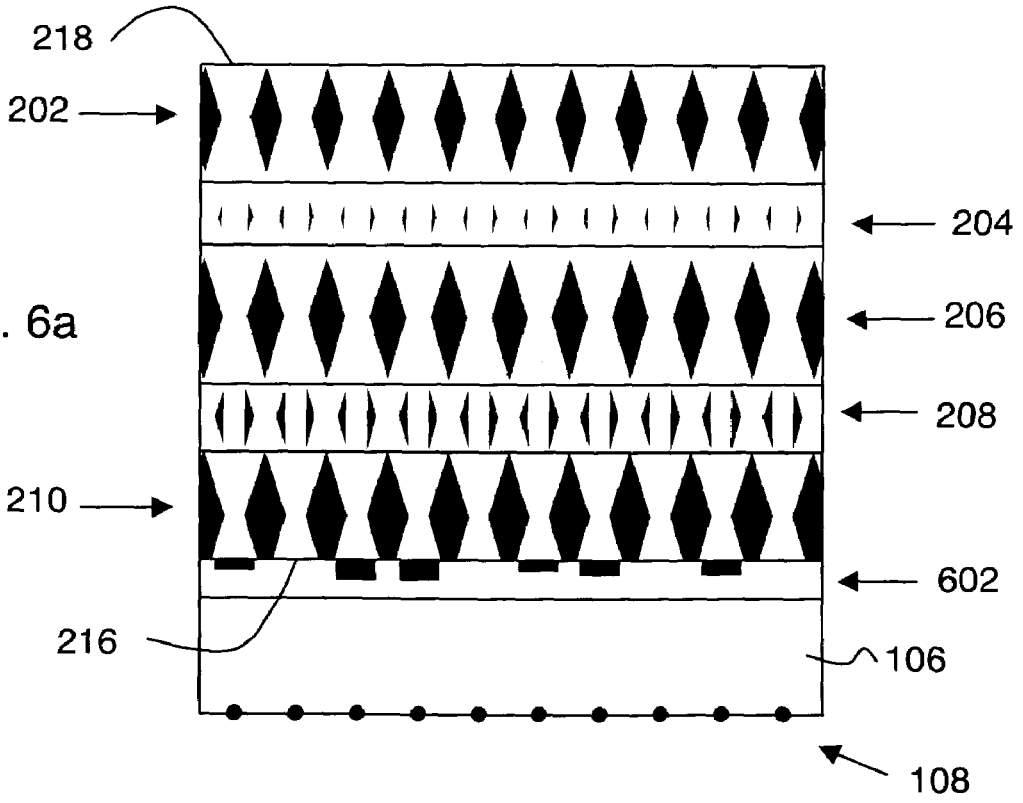
FIGS. 6*a-c* show X-ray collimators according to several embodiments of the invention including a filter layer.
Figure 6B:
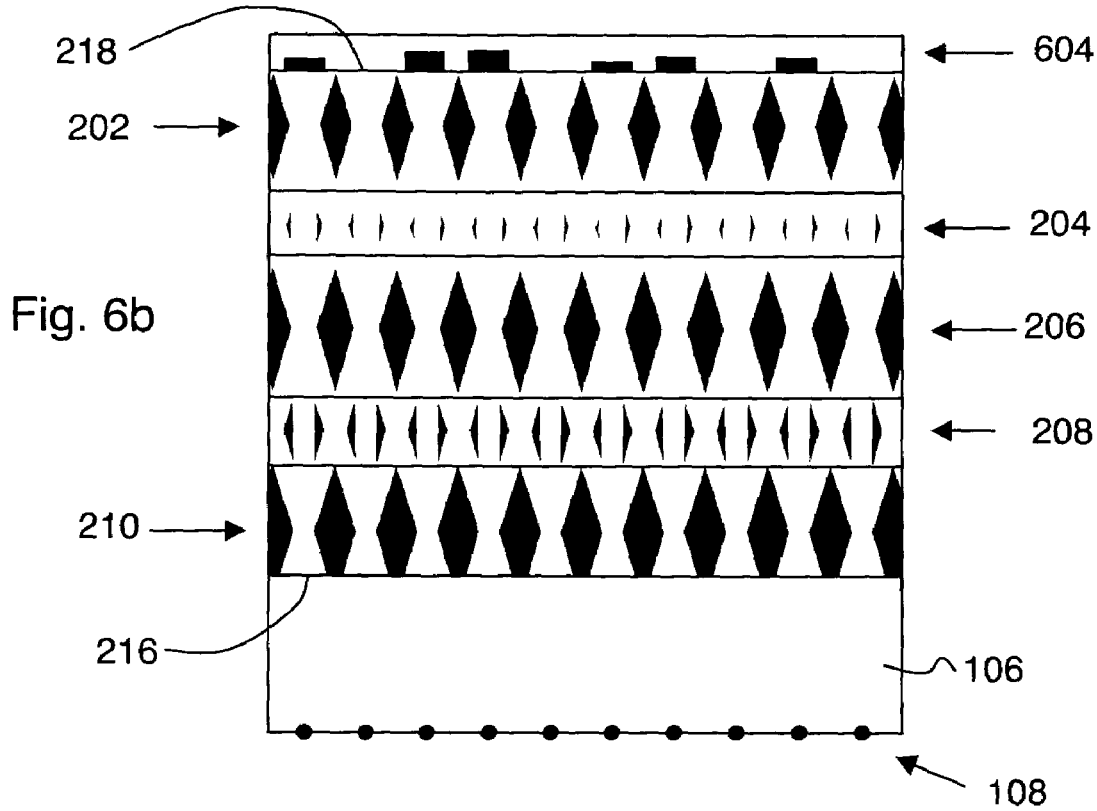
Figure 6C:
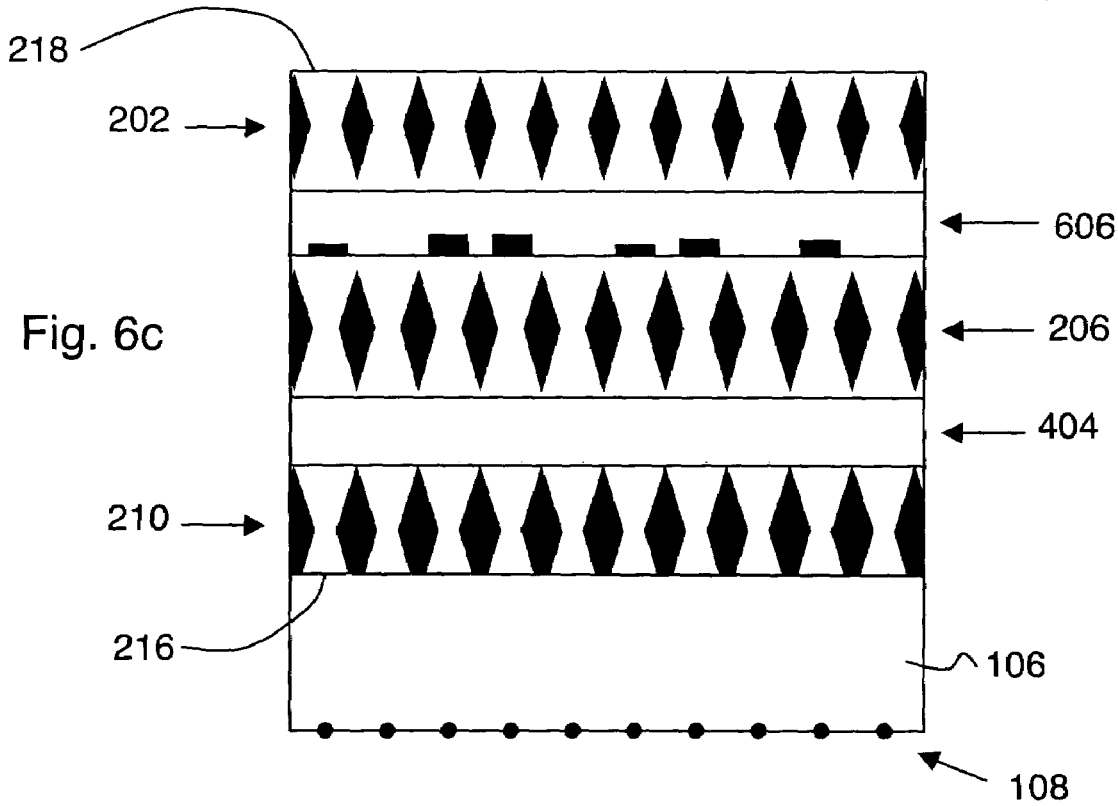

Embodiments of the invention can also be employed to provide differing levels of attenuation for the collimator channels. Such differing attenuation can be provided by adding a filter layer to the basic collimator structure of FIG. 2, to provide independently predetermined levels of X-ray attenuation for channels covered by the filter layer. One application of channel-dependent filtering is to attenuate detectable X-rays traversing through the outer portions relative to the inner portions of the field of view 102. This technique, which is implemented in conventional computed tomography systems by employing a "bow-tie" filter, provides a more uniform X-ray intensity distribution exiting the field of view. One or more filter layers can be employed, and the filter layer or layers can be disposed at the collimator input face, the collimator output face, and/or at an intermediate location. FIGS. 6*a-c* show X-ray collimators according to several embodiments of the invention including a filter layer.

FIG. 6*a* shows an embodiment of the invention having a filter layer 602 disposed at the collimator input face. FIG. 6*b* shows an embodiment of the invention having a filter layer 604 disposed at the collimator output face. FIG. 6*c* shows an embodiment of the invention having a filter layer 606 disposed at an intermediate location between the collimator input and output faces. The per channel attenuation provided by a filter layer can be set by appropriately selecting the composition and/or thickness of the filter layer material in the channel path. Filter layers such as 602, 604, and 606 can be fabricated with the same materials and with the same methods as described above in connection with the high attenuation layers.

The preceding description of the invention has been by way of example as opposed to limitation, and the invention can also be practiced by making various modifications to the given examples. For example, the preceding examples implicitly relate to an X-ray imaging geometry where collimation with intersecting channels is done in the transverse direction. Collimation with intersecting channels can be done in the axial direction in addition to or alternatively to such collimation in the transverse direction.

The invention is broadly applicable to various kinds of X-ray imaging systems, including but not limited to computerized tomography systems, x-ray fluoroscopy systems, and tomosynthesis systems. More generally, the invention is applicable in any situation where multiple source locations are to be collimated to provide efficient irradiation of a field of view in a system having several detectors or detector arrays.

The invention claimed is:

1. An X-ray collimator comprising:

three or more high attenuation layers, each comprising a high-Z material, wherein each high attenuation layer includes two or more through holes;

wherein the high attenuation layers are arranged in a layer by layer stack to form a collimator having an input face and an output face;

wherein the through holes of the high attenuation layers combine to form four or more channels extending through the collimator from the input face and to the output face;

wherein at least two of the channels intersect within the collimator at a location other than at the input face or at the output face.

2. The X-ray collimator of claim 1, wherein said high-Z material is selected from the group consisting of brass, tungsten, lead, molybdenum, and mixtures or alloys thereof.

3. The X-ray collimator of claim 1, wherein at least one pair of adjacent said high attenuation layers are separated by an air gap.

4. The X-ray collimator of claim 1, wherein at least one pair of adjacent said high attenuation layers are separated by a transparent layer.

5. The X-ray collimator of claim 4, wherein said transparent layer comprises a material selected from the group consisting of low-Z materials, low density plastics, fiber material, carbon fiber, Al, and microspheres in an epoxy matrix.

6. The X-ray collimator of claim 1, wherein at least one of said channels intersects with two or more of said channels within the collimator at locations other than at said input face or at said output face.

7. The X-ray collimator of claim 1, wherein each of said channels is centered on a straight line.

8. The X-ray collimator of claim 1, wherein each of said channels is larger at said output face than at said input face.

9. The X-ray collimator of claim 1, further comprising a filter layer adjacent to said input face and covering one or more of said channels, wherein said filter layer provides independently predetermined levels of X-ray attenuation for each of the covered channels.

10. The X-ray collimator of claim 1, further comprising a filter layer adjacent to said output face and covering one or more of said channels, wherein said filter layer provides independently predetermined levels of X-ray attenuation for each of the covered channels.

11. The X-ray collimator of claim 1, further comprising a filter layer between said input face and said output face and interrupting one or more of said channels, wherein said filter layer provides independently predetermined levels of X-ray attenuation for each of the interrupted channels.

12. An X-ray imaging system comprising:

one or more X-ray sources providing two or more X-ray source locations;

two or more X-ray detectors;

an X-ray collimator according to claim 1; and wherein each said channel of said X-ray collimator is aligned to permit X-rays to travel from one of the X-ray source locations to one of the X-ray detectors.

13. The imaging system of claim 12, wherein X-rays emitted from said source locations and directed away from any of said X-ray detectors are substantially absorbed in said X-ray collimator.

14. The imaging system of claim 12, wherein said channels permit X-rays to travel from each of said X-ray source locations to all of said X-ray detectors.

15. The imaging system of claim 12, wherein said channels permit X-rays to travel from each of said X-ray source locations to one or more of said X-ray detectors.

16. The imaging system of claim 12, wherein said imaging system is selected from the group consisting of computerized tomography systems, x-ray fluoroscopy systems, or tomosynthesis systems.

* * * * *